US007118175B2

(12) United States Patent
Crue

(10) Patent No.: US 7,118,175 B2
(45) Date of Patent: Oct. 10, 2006

(54) SECURELY STACKING BAR STOOLS

(75) Inventor: Dean Crue, Northbrook, IL (US)

(73) Assignee: Vendor Development Group, Chicago, IL (US)

( * ) Notice: Subject to any disclaimer, the term of this patent is extended or adjusted under 35 U.S.C. 154(b) by 349 days.

(21) Appl. No.: 10/664,365

(22) Filed: Sep. 17, 2003

(65) Prior Publication Data

US 2004/0061365 A1 Apr. 1, 2004

Related U.S. Application Data

(63) Continuation-in-part of application No. 10/235,459, filed on Sep. 5, 2002, now abandoned.

(60) Provisional application No. 60/317,267, filed on Sep. 5, 2001.

(51) Int. Cl.
*A47C 3/04* (2006.01)

(52) U.S. Cl. ..... 297/239

(58) Field of Classification Search ..... 297/239
See application file for complete search history.

(56) References Cited

U.S. PATENT DOCUMENTS

| | | | | |
|---|---|---|---|---|
| 1,922,418 | A | 8/1933 | Coriant | |
| 2,952,300 | A * | 9/1960 | Cohen | 297/239 |
| 3,025,105 | A * | 3/1962 | Nash | 297/239 |
| 3,133,762 | A * | 5/1964 | Newman | 297/239 |
| 3,351,378 | A * | 11/1967 | Bliss | 297/239 |
| 3,446,530 | A * | 5/1969 | Rowland | 297/239 |
| 4,304,436 | A | 12/1981 | Rowland | |
| 4,341,419 | A | 7/1982 | Sebel | |
| 4,366,980 | A | 1/1983 | Rowland | |
| 4,456,296 | A | 6/1984 | Rowland | |
| 4,807,929 | A | 2/1989 | Balsbaugh | |
| 4,998,774 | A | 3/1991 | Huff et al. | |
| 5,002,337 | A | 3/1991 | Engel et al. | |
| 5,044,691 | A * | 9/1991 | Guichon | 297/239 |
| 5,060,896 | A | 10/1991 | Hobbins | |
| 5,524,963 | A | 6/1996 | Barile | |
| 5,536,068 | A | 7/1996 | Valentor et al. | |
| 5,678,892 | A | 10/1997 | Heitlinger | |
| 5,762,396 | A | 6/1998 | Barile | |
| 5,803,540 | A | 9/1998 | Schwartz | |
| 5,813,722 | A * | 9/1998 | Smith | 297/239 |
| 5,997,084 | A | 12/1999 | Barile, Jr. et al. | |
| D420,821 | S | 2/2000 | Barile et al. | |
| D433,829 | S | 11/2000 | Barile et al. | |
| D433,830 | S | 11/2000 | Barile et al. | |
| 6,666,518 | B1 * | 12/2003 | Bruschi et al. | 297/440.14 |

FOREIGN PATENT DOCUMENTS

| | | | |
|---|---|---|---|
| FR | 2586916 | * | 3/1987 |
| WO | WO 99/32015 | | 7/1999 |

* cited by examiner

*Primary Examiner*—Peter R. Brown
(74) *Attorney, Agent, or Firm*—McAndrews, Held & Malloy, Ltd.

(57) ABSTRACT

Securely stacking and height adjustable bar stools are provided. In one embodiment of the present invention, the seat of a bar stool includes an upper leg restraining system that accommodates a pair of legs from another bar stool that is to be securely stacked on top. In conjunction with the upper leg restraining system, a leg bracing system is provided to accommodate and restrain the pair of legs from another bar stool. In addition, the seat height of a bar stool may be incrementally increased by attaching a plurality of leg extenders to previously added leg extenders until a desired bar stool seat height has been attained.

3 Claims, 7 Drawing Sheets

SECURELY STACKING BAR STOOLS

CROSS-REFERENCE TO RELATED APPLICATIONS

The present application is a continuation-in-part application of U.S. patent application Ser. No. 10/235,459, filed Sep. 5, 2002, now abandoned which claims the benefit of U.S. Provisional Application No. 60/317,267, Sep. 5, 2001.

STATEMENT REGARDING FEDERALLY SPONSORED RESEARCH OR DEVELOPMENT

Not Applicable.

REFERENCE TO MATERIALS ON COMPACT DISC

Not Applicable.

BACKGROUND OF THE INVENTION

The present invention generally relates to a bar stool. More particularly, the present invention relates to a bar stool that may be securely stacked with at least one other similar bar stool and/or is configurable to a variety of seat heights.

Bar stools are currently in wide use by consumers in a variety of applications and settings. The original use of a bar stool is as a high seat for patrons of a bar, tavern or other drinking establishment. However, in recent years, the use of bar stools has spread to residential settings including use at home bars and for use in kitchens.

When bar stools were used in a bar or tavern, the bar stool was merely positioned near the bar and left in that location permanently. However, in residential environments for example, consumers often wish to use bar stools for a temporary time period, such as only when guests are being entertained. Consequently, the consumers may prefer to store the bar stools when not in use. A convenient way of storing bar stools is by stacking the bar stools.

For example, a design for a stacking bar stool is disclosed in Barile et al., U.S. Pat. No. D420,821. The stacking bar stool of Barile has two front legs, two rear legs, a seat, a footrest and a backrest. The two rear legs of the bar stool in Barile are spaced apart a distance greater than the width of the seat. Spacing the rear legs farther apart than the width of the seat allows the rear legs of an upper bar stool to clear the seat of a lower bar stool when an upper bar stool is stacked on top of a lower bar stool. After clearing the seat of the lower bar stool, the legs of the upper bar stool are located flush with the front of the lower bar stool's legs.

Similar to a stacking bar stool, a design for a stackable chair is disclosed in Engel et al., U.S. Pat. No. 5,002,337. The stacking chair in Engel includes a seat with cut-out corner regions and inclined legs. When an upper chair is stacked on a lower chair, the cut-out corner regions allow the inclined legs of the upper chair to nest on top of the inclined legs of the lower chair.

While it is convenient to stack bar stools, the size and weight of bar stools may make them awkward and unsafe to stack. An upper bar stool may wobble and shift around when placed on top of a lower bar stool. The upper bar stool may even shift far enough forward that it falls off the lower bar stool or causes both bar stools to tip over resulting in damage to the bar stools or surrounding equipment. In addition to damaging the bar stools or surrounding equipment, the falling bar stools may pose a hazard for children or other passersby who may be struck by the falling bar stools. To prevent stacked bar stools from falling over, the bar stool is preferably constructed with a motion restraining system to prevent an upper bar stool from falling off a lower bar stool.

For example, the stacking chair of Engel restrains forward movement of an upper chair by nesting the legs of the upper chair on top of the legs of the lower chair. When the upper chair attempts to slide forward, the rear legs of the upper chair are prevented from sliding forward by the rear legs of the lower chair. Consequently, the upper chair is restrained from falling off the lower chair.

In contrast, Barile uses a footrest to restrain the movement of an upper bar stool when stacked on a lower bar stool. To provide restraint, two side portions of the footrest taper outward on an angle from the inside edges of the rear two legs to the outside edges of the two front legs. By tapering the two side portions of the footrest outward, the spacing between the two side portions of the footrest gradually increases towards the front legs. When an upper bar stool is stacked on top of a lower bar stool, the rear legs of the upper bar stool are positioned in front of the rear legs of the lower bar stool. As the upper bar stool slides forward, the rear legs of the upper bar stool eventually contact the two side portions of the footrest where the spacing exceeds the distance between the two rear legs. Consequently, the two rear legs are prevented from sliding further forward and the upper bar stool is restrained from falling off the lower bar stool.

In order to optimally secure an upper bar stool to a lower bar stool, it may be preferable to secure the legs at a location near the top of the legs. In addition, it may be preferable to secure the legs of an upper bar stool at more than one location along the length of the legs.

For example, the bar stool of Barile provides a single restraint to forward motion located in the lower half of the bar stool legs. When an upper bar stool is subjected to a force pulling the upper bar stool forward, the rear legs of the upper bar stool will be subjected to stress and strain. By locating the leg restraint in the lower half of the bar stool legs, the legs of an upper bar stool may be subjected to higher levels of stress and strain from a force pulling forward on the backrest of the upper bar stool than if the leg restraint was located in the top half of the bar stool legs. Addtionally, more than one leg restraint may reduce concentrations of stress and strain along the legs of an upper bar stool when subjected to a force pulling forward on the backrest. By including more than one leg restraint, the distribution of stress and strain may be altered to a more even distribution along the length of the legs. Thus, it may be highly desirable to have a stackable bar stool with a leg restraint near the top of the bar stool legs. It may also be desirable to have a stackable bar stool with more than one leg restraint.

Because consumers may use a bar stool in a variety of locations, a bar stool of one seat height may not be suitable in a location where a bar stool of another seat height is desired. For example, a kitchen island countertop in a residence may be positioned at a different height than the counter of a bar in a tavern. Also, a shorter individual may desire a bar stool of a different seat height than a taller individual. For example, a shorter individual may desire a taller bar stool to place the shorter individual at a comfortable level with a counter while a taller individual may desire a shorter bar stool to place the taller individual at the same level with the same counter. Thus, a desirable seat height for a bar stool may depend on the location where the bar stool is used or the height of the individual using the bar stool.

Currently, bar stools of different fixed seat heights are sold to meet a variety of bar stool seat heights demanded by consumers. Typical seat heights may range from 24–30 inches with custom seat heights from 30–42 inches being available. Having to order different bar stools based upon the seat height is inefficient and costly. The consumer may have to purchase bar stools of a fixed seat height for a particular location or a particular person. If the consumer desires to use the bar stools at another location or use the bar stools for another person, the consumer may be forced to purchase additional bar stools if the desirable seat height of the bar stools for the new use is different than the desirable seat height for the old use. Purchasing new bar stools each time the conditions of use change may be a costly and an inefficient use of bar stools. Thus, it may be highly desirable to have a bar stool that may be configured by a consumer to a variety of seat heights.

Fixed seat height bar stools may also be costly and inefficient for suppliers. Currently, suppliers may have to maintain an inventory of bar stools of many different seat heights to quickly supply the range of bar stool seat heights demanded by consumers. Rather than store the bar stools, suppliers may choose to reduce inventory by waiting and manufacturing bar stools as orders are placed. Manufacturing bar stools as orders are placed may increase supply times and dissatisfy consumers. Thus, it may be desirable to reduce inventory by stocking a bar stool that may be configured to a variety of seat heights shortly before shipment from the supplier or after receipt by the consumer.

Existing height adjustment systems for furniture do not specifically address bar stools, but some systems do adjust the seat height of chairs. Typical height adjustment systems for chairs attach different types of unreliable and externally obvious extenders to the legs of a chair to increase the seat height of the chair.

For example, one height adjustment system is disclosed in Valentor et al., U.S. Pat. No. 5,536,068. The height adjustment system of Valentor discloses adjusting the seat height of a chair by rotating a threaded member that is threadably received into the bottom of the feet of a chair. The threaded member may be adjusted between a minimum and maximum level to raise and lower the seat height of a chair. The ends of the threaded member are terminated with a cap that attaches to the end of the threaded member.

However, the height adjustment system of Valentor may require periodic readjustment due to undesired rotation of the threaded member. The threaded member used for adjusting the height of the chair in Valentor lacks physical stops along the threaded member. Excessive weight on the chair or movement of the chair may cause one or more of the threaded members to rotate further into the leg of the chair. As a result, some of the threaded members may end up adjusted to a different height than the remaining threaded members. A chair with some threaded members adjusted to a different height than the other threaded members will be subject to wobbling and falling over. Thus, it may be highly desirable to have leg extenders that attach to the feet of a chair or bar stool where the leg extenders include a physical stop to maintain the adjusted height of the chair. Additionally, it may be highly desirable to provide a height adjustment system that provides consistent and reliable height adjustment.

Furthermore, once the maximum adjustable limit of a height adjuster like that in Valentor has been reached, a consumer may not increase the height of the chair any further with that particular height adjuster. If the consumer desires to raise the seat height of the chair any further, the consumer may have to replace the entire set of height adjusters with another set of longer height adjusters. Completely replacing a shorter set of height adjusters with a new set of longer height adjusters may be costly and a waste of natural resources. Thus, it may be desirable to have a height adjustment system where additional sets of leg extenders may be safely attached to another set of leg extenders to increase the seat height of a bar stool.

BRIEF SUMMARY OF THE INVENTION

A preferred embodiment of the present invention provides a bar stool that is securely stacking and/or height adjustable. The bar stool may be securely stacked through the use of a forward motion restraining system and a leg bracing system. The forward motion restraining system provides a location where a pair of legs from the upper bar stool may be positioned when the upper bar stool is stacked on top of the lower bar stool. When the legs of the upper bar stool are positioned in the forward motion restraining system, the upper bar stool is prevented from sliding off the top of the lower bar stool. The leg bracing system of a lower bar stool includes a footrest attached to the legs of the lower bar stool. The footrest accommodates and braces a pair of legs from an upper bar stool when the upper bar stool is stacked on top of the lower bar stool.

To adjust a bar stool to various heights, leg extenders may be added to the feet of the bar stool to raise the seat height. The leg extenders include a fixed stopping point in order to maintain the bar stool at the adjusted height. After a first set of leg extenders have been added to the feet of a bar stool, an additional set of leg extenders may be attached to the first set of leg extenders to further raise the seat height. Additional sets of leg extenders may be repeatedly attached to prior attached sets of leg extenders to ultimately raise the bar stool to a desired seat height.

DETAILED DESCRIPTION OF THE INVENTION

Figure 1:
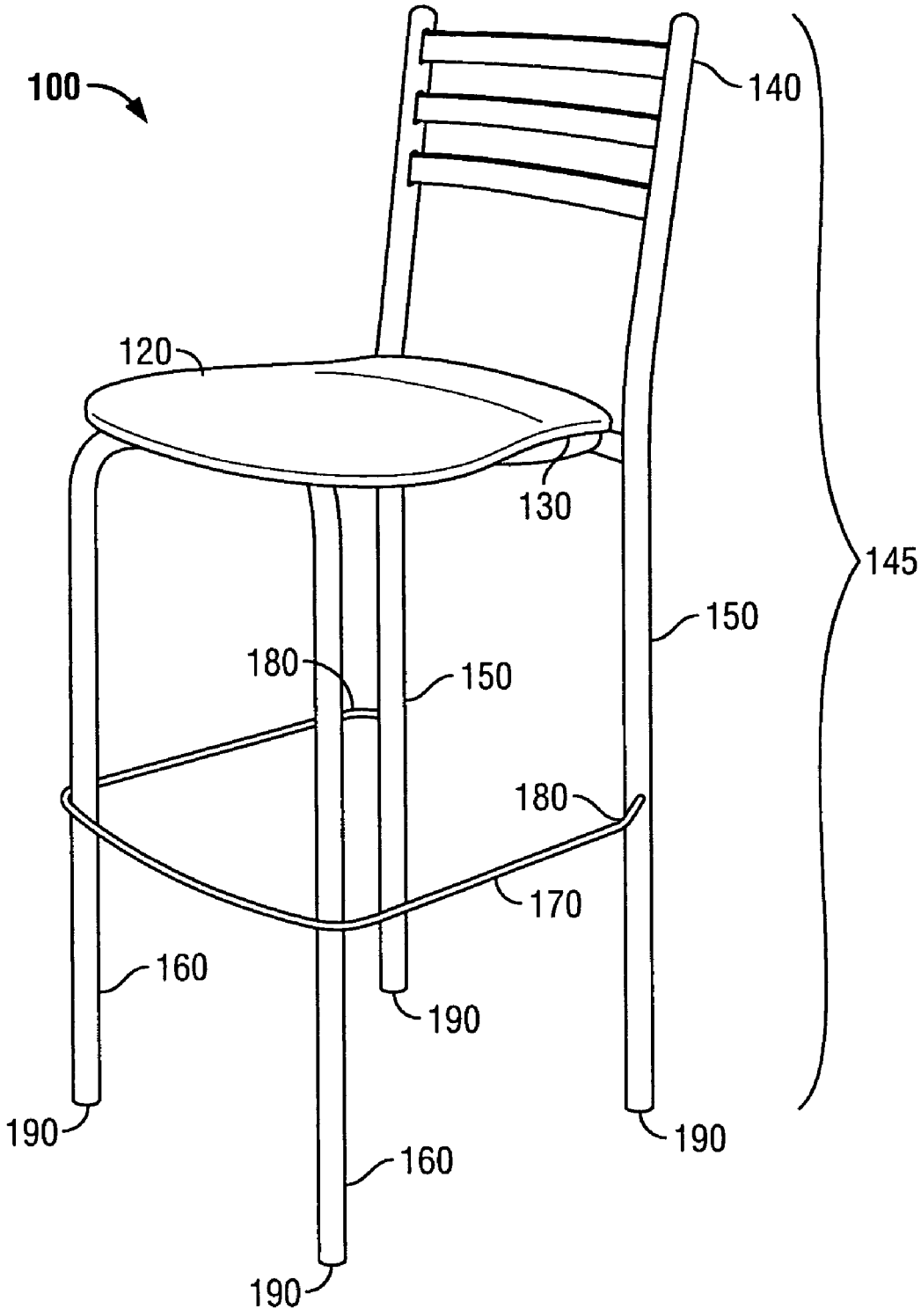
FIG. 1 illustrates a perspective view of a securely stacking bar stool in accordance with an embodiment of the present invention.

FIG. 1 illustrates a securely stacking bar stool 100 in accordance with an embodiment of the present invention. The securely stacking bar stool 100 includes a seat 120, a forward motion restraining system 130, a backrest 140, rear legs 150, front legs 160, a footrest 170, a leg bracing system 180, and feet 190.

The rear legs 150 and front legs 160 connect to the seat 120. The feet 190 include bottom surfaces of the rear legs 150 and front legs 160. The forward motion restraining system 130 includes a cut-out in the seat 120. The backrest 140 is connected to the rear legs 150. The footrest 170 is connected to the rear legs 150 and front legs 160. The footrest 170 includes the leg bracing system 180.

In operation, the securely stacking bar stool 100 may be securely stacked with one or more similar bar stools. For example, as further described below, a pair of bar stools may be stacked securely because an upper bar stool is secured to a lower bar stool through the use of a forward motion restraining system and a leg bracing system.

Figure 2:
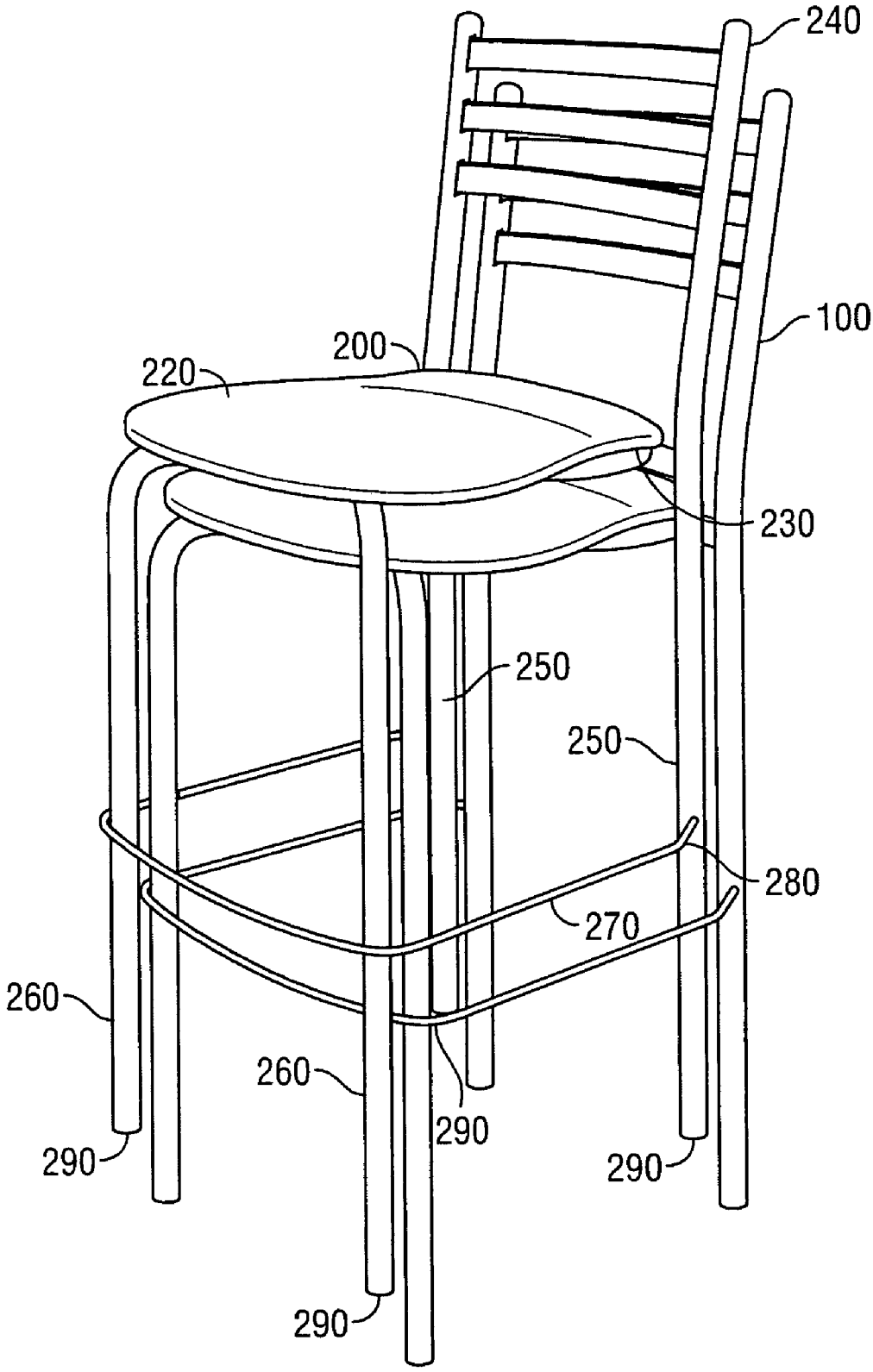
FIG. 2 illustrates the securely stacking bar stool shown in FIG. 1 with another securely stacking bar stool securely stacked on top in accordance with an embodiment of the present invention.

FIG. 2 illustrates the securely stacking bar stool 100 of FIG. 1 with a similar upper bar stool 200 stacked on top in accordance with an embodiment of the present invention. Similar to the securely stacking bar stool 100, the upper bar stool 200 includes a seat 220, a forward motion restraining system 230, a backrest 240, rear legs 250, front legs 260, a footrest 270, a leg bracing system 280, and feet 290.

In operation, the upper bar stool 200 is positioned vertically above the securely stacking bar stool 100. The rear legs 250 of the upper bar stool 200 are aligned vertically with the cut-out of the forward motion restraining system 130. As the upper bar stool 200 is lowered onto the securely stacking bar stool 100, the feet 290 clear the edges of the seat 120 and the rear legs 250 slide into the forward motion restraining system 130.

After sliding into the forward motion restraining system 130, the rear legs 250 are aligned with openings provided by bends in the footrest 170 of the leg bracing system 180. As the upper bar stool 200 continues to be lowered onto the securely stacking bar stool 100, rear legs 250 slide into the openings provided by the bends in the footrest 170 of the leg bracing system 180. When the bottom of the seat 220 of the upper bar stool 200 contacts the seat 120 of the securely stacking bar stool 100, the rear legs 250 of the upper bar stool 200 are positioned inside the leg bracing system 180 and the forward motion restraining system 130 of the securely stacking bar stool 100.

If the upper bar stool 200 begins to slide forward on the securely stacking bar stool 100, the rear legs 250 come into contact with the edges of the cut-out portion of the forward motion restraining system 130 on the securely stacking bar stool 100. Contact of the rear legs 250 with the edges of the forward motion restraining system 130 restrains the upper bar stool 200 from sliding forward on the securely stacking bar stool 100. Consequently, the upper bar stool 200 is prevented from falling off the front of the securely stacking bar stool 100.

In addition to preventing forward motion of the upper bar stool 200 with the forward motion restraining system 130, the securely stacking bar stool 100 prevents backward horizontal movement of the upper bar stool 200. When the upper bar stool 200 is stacked on top of the securely stacking bar stool 100, the rear legs 250 and backrest 240 of the upper bar stool 200 are positioned in front of the rear legs 150 and backrest 140 of the securely stacking bar stool 100. As the upper bar stool 200 starts to slide backward on top of the securely stacking bar stool 100, the rear legs 250 of the upper bar stool 200 contact a backstop restraining system 145 that includes the rear legs 150 and backrest 140 of the securely stacking bar stool 100. Contact with the backstop restraining system 145 restrains backward motion of the rear legs 250 of the upper bar stool 200. Consequently, the upper bar stool 200 is prevented from falling off the back of the securely stacking bar stool 100.

Thus, an upper bar stool 200 may be optimally secured to a securely staacking bar stool 100 with a forward motion restraining system 130 located in the seat 120 of the securely stacking bar stool 100 and a backstop restraining system 145. By locating the forward motion restraining system 130 in the seat of the securely stacking bar stool 100, the rear legs 250 of the upper bar stool 200 are restrained near the top of the rear legs 250. Restraining the rear legs 250 of the upper bar stool 200 near the top of the rear legs 250 may minimize the level of stress and strain in the rear legs 250 when the upper bar stool 200 is subjected to a force pulling forward on the backrest 240. Minimizing the level of stress and strain experienced by the rear legs 250 of the upper bar stool 200 reduces the likelihood of damage to the rear legs 250.

To further restrain movement of the upper bar stool 200, the securely stacking bar stool 100 also includes the leg bracing system 180. As mentioned above, the leg bracing system 180 of the securely stacking bar stool 100 accommodates the rear legs 250 of the upper bar stool 200. When the upper bar stool 200 is stacked on top of the securely stacking bar stool 100, the rear legs 250 of the upper bar stool 200 are positioned within the bends in the footrest 170 of the leg bracing system 180. The bends in the footrest 170 allow for the rear legs 250 of the upper bar stool 200 to be seated on the inside edge of the footrest 170.

When the upper bar stool 200 is moved sideways, one of the rear legs 250 is pressed against and restrained by the inside edge of the footrest 170. By preventing one of the rear legs 250 of the upper bar stool 200 from moving sideways, the seat of the upper bar stool 200 which is connected to the rear legs 250 is restrained from moving sideways. Consequently, the footrest 170 of the leg bracing system 180 restrains the upper bar stool 200 from sliding sideways on top of the securely stacking bar stool 100.

Figure 3:
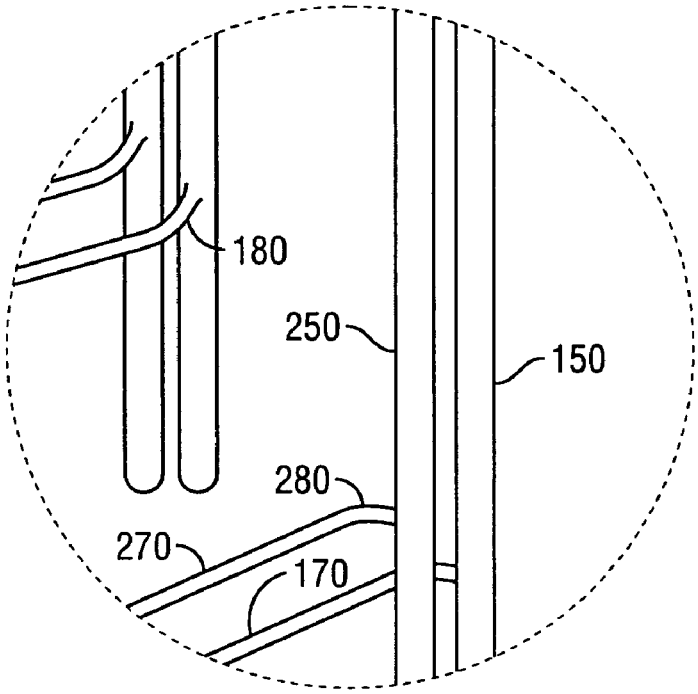
FIG. 3 illustrates an alternative embodiment of a leg bracing system for the securely stacking bar stool.

FIG. 3 illustrates an alternative leg bracing system 180 with inward bends on the footrest 170. Similar to the outward bends illustrated in FIG. 2, inward bends restrain the rear legs 250 of an upper bar stool 200 from shifting side-to-side when an upper bar stool 200 is stacked on top of a securely stacking bar stool 100. When the upper bar stool 200 is moved sideways, one of the rear legs 250 of the upper bar stool 200 is pressed against and restrained by the outside edge of the footrest 170. By preventing one of the rear legs 250 of the upper bar stool 200 from moving sideways, the seat of the upper bar stool 200 which is connected to the rear legs 250 is prevented from moving sideways. Consequently, the footrest 170 with inward bends restrains the upper bar stool 200 from sliding sideways on top of the securely stacking bar stool 100.

Figure 4:
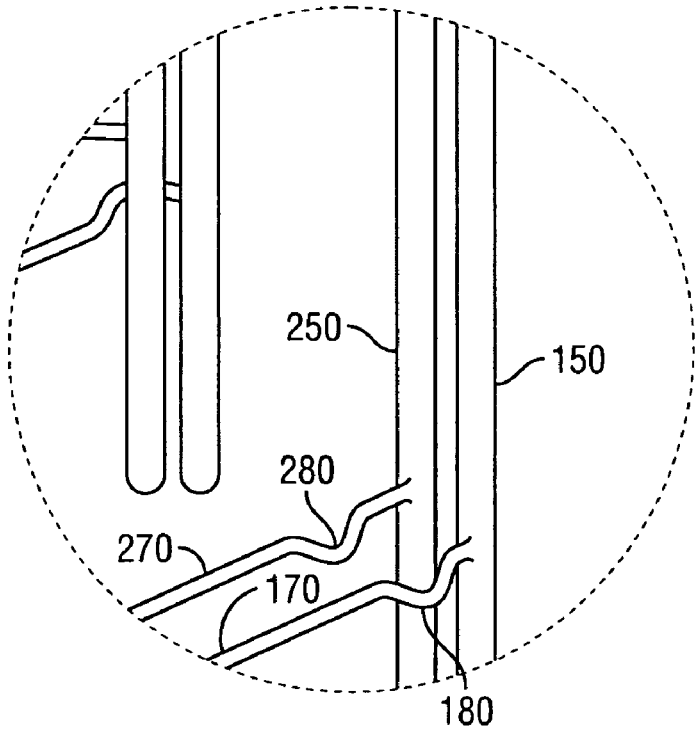
FIG. 4 illustrates an alternative embodiment of a leg bracing system for the securely stacking bar stool.

FIG. 4 illustrates an alternative leg bracing system 180 with notches in the footrest 170. When the upper bar stool 200 is stacked on top of the securely stacking bar stool 100, the rear legs 250 of the upper bar stool 200 are positioned within the notches in the footrest 170 of the securely stacking bar stool 100. The notches in the footrest 170 bend around the rear legs 250 of the upper bar stool 200. As the upper bar stool 200 starts to move forward or backwards, the rear legs 250 of the upper bar stool 200 press against the sides of the notches in the footrest 170. Similarly, as the upper bar stool 200 starts to move sideways, one of the rear legs 250 of the upper bar stool 200 presses against the inside of one of the notches in the footrest 170. As the rear legs 250 of the upper bar stool 200 press against the sides of the notches in the footrest 170, motion of the rear legs 250 is restrained. By restraining motion of the rear legs 250, motion of the upper bar stool 200 is restrained. Consequently, notches in the footrest 170 of the leg bracing system 180 restrict forward motion, backward motion and side motion of the upper bar stool 200.

Figure 5:
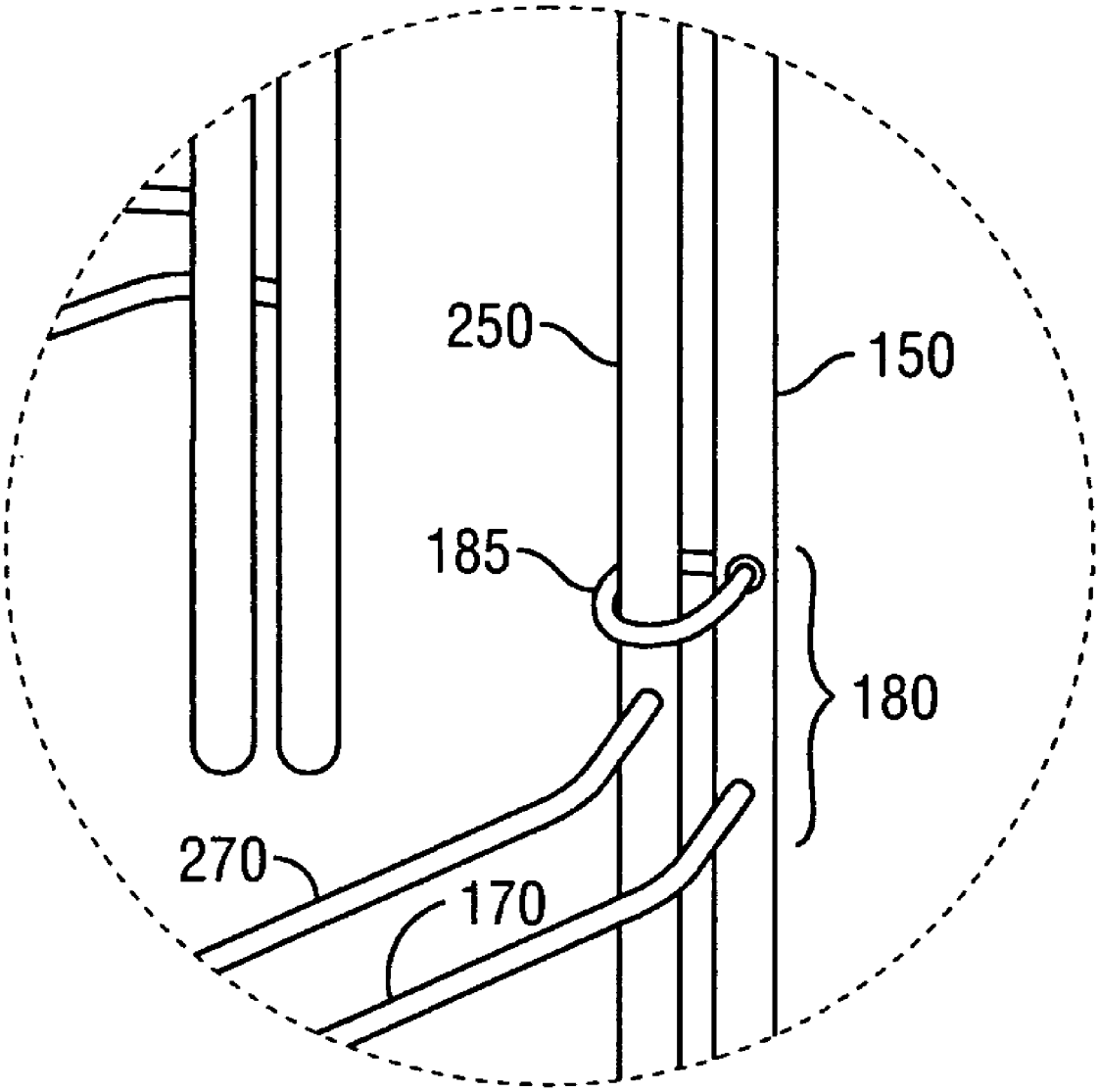
FIG. 5 illustrates an alternative embodiment of a leg bracing system for the securely stacking bar stool.

FIG. 5 illustrates an alternative leg bracing system 180 with fasteners 185 and bends in the footrest 170. As previously described, the bends in the footrest 170 restrain sideways movement of the rear legs 250 of the upper bar stool 200. To restrain forward movement of the rear legs 250, the leg bracing system 180 includes the fasteners 185. The fasteners 185 may be pieces of rope with female portions of a snap fitting on one end that snap to male portions of a snap fitting attached to the rear legs 150 of the securely stacking bar stool 100. The remaining ends of the ropes are each attached to one of the rear legs 150 of the securely stacking bar stool 100.

After the upper bar stool 200 is in place and stacked on top of the securely stacking bar stool 100, the ropes are wrapped around the rear legs 250 of the upper bar stool 200. The female portions of snap fittings on the ends of the ropes are then engaged with the male portions of snap fittings attached to each of the rear legs 150 of the securely stacking bar stool 100. By wrapping the ropes around the rear legs 250 of the upper bar stool 200 and securing the ends of the ropes to the securely stacking bar stool 100, the rear legs 250 of the upper bar stool 200 are restrained from moving forward.

Rather than ropes with snap fittings, the fasteners 185 may also be of the hook and loop type. Each of the hook halves and the loop halves of the fasteners 185 are attached to one of the rear legs 150 of the securely stacking bar stool 100. After the upper bar stool 200 is in place and stacked on top of the securely stacking bar stool 100, the hook halves and loop halves of the fasteners 185 are wrapped around the rear legs 250 of the upper bar stool 200. The hook halves and loop halves of the fasteners 185 engage each other to secure the rear legs 250 of the upper bar stool 200 to the rear legs 150 of the securely stacking bar stool 100. By securing the rear legs 250 of the upper bar stool 200 to the rear legs 150 of the securely stacking bar stool 100, the upper bar stool 200 is restrained from sliding forward on top of the securely stacking bar stool 100.

Thus, the use of the leg bracing system 180 may provide a point of restraint for the rear legs 250 of an upper bar stool 200 when stacked on top of a securely stacking bar stool 100. Use of the leg bracing system 180 in conjunction with the forward motion restraining system 130 provides additional restrained points along the length of the rear legs 250 of the upper bar stool 200. Provision of additional restrained points along the rear legs 250 of the upper bar stool 200, may reduce concentrations of stress and strain along the length of the rear legs 250. By reducing the concentrations of stress and strain along the rear legs 250 of the upper bar stool 200, the likelihood of damage to the rear legs 250 of the upper bar stool 200 is reduced.

Figure 6:
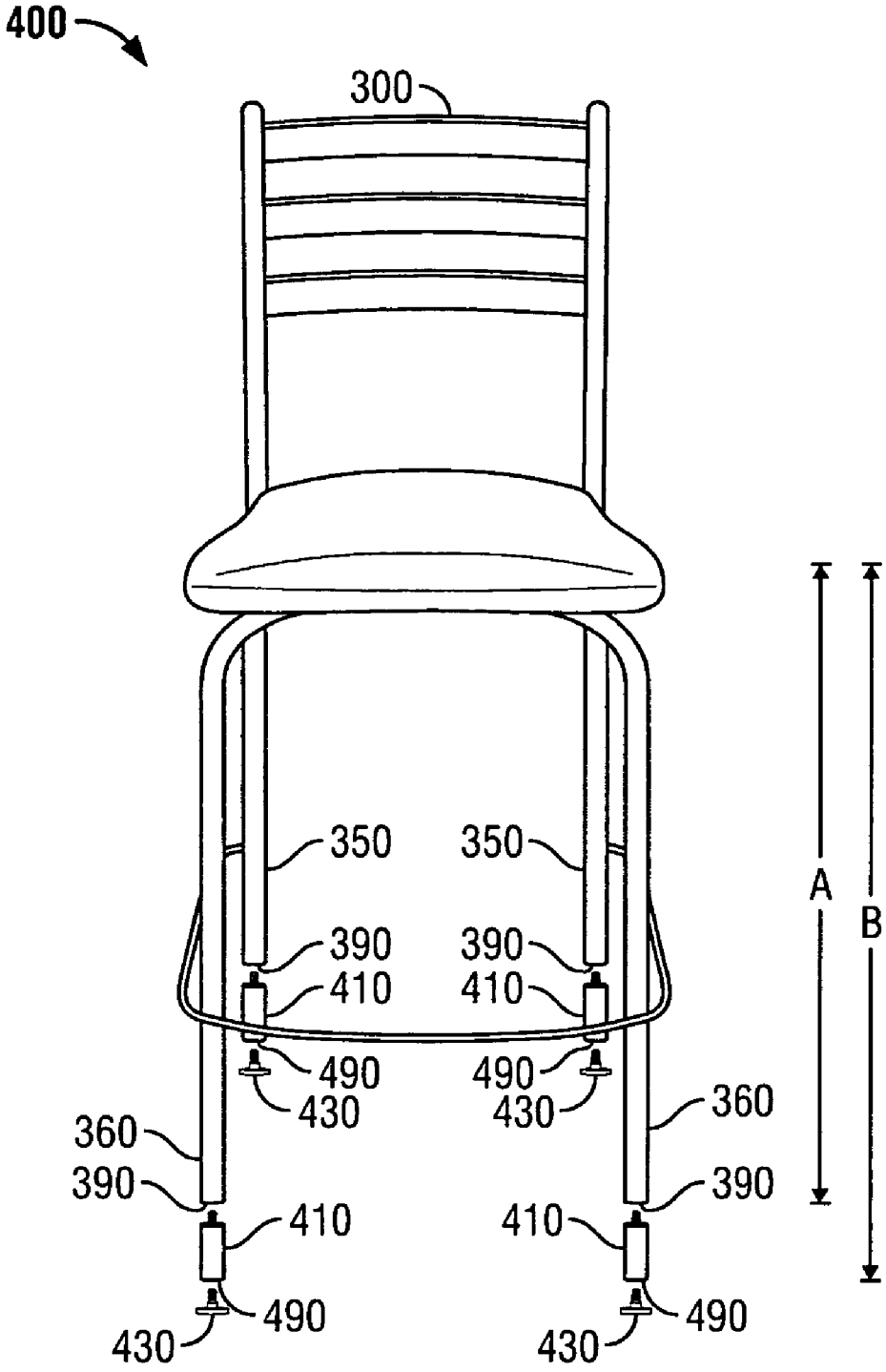
FIG. 6 illustrates a bar stool configured to an adjusted seat height with leg extenders in accordance with an embodiment of the present invention.
Figure 8:
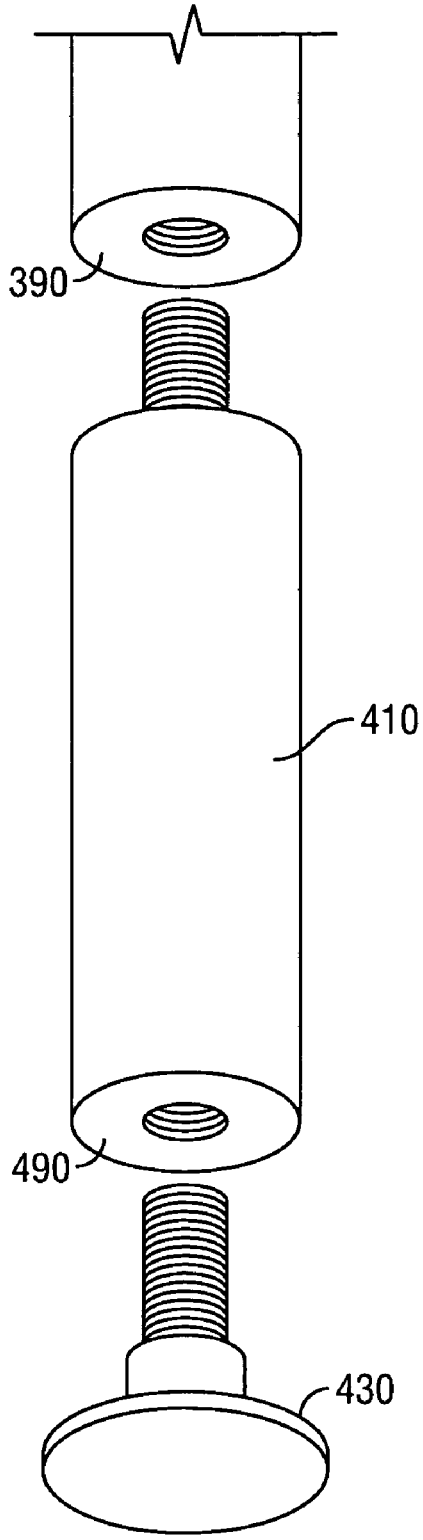
FIG. 8 illustrates a leg extender in accordance with an embodiment of the present invention.

FIG. 6 illustrates a bar stool 300 with leg extenders 410 attached to produce a reconfigured bar stool 400 in accordance with an embodiment of the present invention. The bar stool 300 includes rear legs 350, front legs 360, and feet 390. An enlarged view of an embodiment of the leg extenders 410 is shown in FIG. 8.

The feet 390 include bottom surfaces of the rear legs 350 and the front legs 360. The leg extenders 410 engage the bottom surfaces of the feet 390 of the rear legs 350 and the front legs 360 with screw threaded connections. End caps 430 engage the bottom surfaces 490 of the leg extenders 410 with screw threaded connections.

In operation, a bar stool 300 of a fixed seat height A is provided. A seat height B of the desired reconfigured bar stool 400 is determined. One leg extender 410 for each leg of the bar stool 300 is selected from a set of leg extenders 410 of a length that will adjust the bar stool 300 from a fixed seat height A to a reconfigured seat height of B.

After the leg extenders 410 have been selected, a male threaded connector on one end of each leg extender 410 is aligned with a respective female threaded connector located on the bottom surface of each of the feet 390 of the bar stool 300. Each leg extender 410 is threaded into the respective female threaded connector and rotated until a fixed stopping point is reached. The fixed stopping point is provided by a top surface of each leg extender 410 where the male threaded connector is attached to the leg extender 410. Consequently, the seat height of the bar stool 300 is increased from a seat height of A without the leg extenders 410 to a reconfigured seat height of B with the leg extenders 410 attached to the bottom surfaces of the feet 390.

Because the bottom surfaces 490 of the leg extenders 410 will be in contact with a floor surface when attached to the bottom surfaces of the feet 390 of the bar stool 300, it may be desirable to provide a finished surface to the bottom surfaces 490. To provide a finished surface to the bottom surfaces 490 of the leg extenders 410, end caps 430 may be engaged with threaded connections to the bottom surfaces 490 of the leg extenders 410. A male threaded connector on the top of each end cap 430 is aligned with a respective female threaded connector located on the bottom surface 490 of each leg extender 410. Each end cap 430 is threaded into the respective female threaded connector and rotated until the top surface of each end cap 430 is reached.

To produce a desired level of friction between the reconfigured bar stool 400 and a floor surface, the surface of the end caps 430 may be varied between a low friction surface and a high friction surface. For example, the surface of the end caps 430 may be smooth to provide a low friction surface and rubber coated or roughened to provide a higher friction surface.

In the alternative, the leg extenders 410 may engage the bottom surfaces of the feet 390 of the front legs 360 and the rear legs 350 with wood pegs, dowels, glue, or other suitable means of engagement. Furthermore, the leg extenders 410 may include finished feet 490 with a surface that does not require the attachment of end caps 430.

Thus, rather than purchase different fixed height bar stools for use in particular locations or for use by particular people, a consumer may purchase a bar stool 300 of a fixed seat height and adjust the seat height of the bar stool 300 for use in a variety of locations or by a variety of people. To adjust the seat height of the bar stool 300, leg extenders 410 may be added or removed, as desired.

For example, a consumer may purchase a bar stool with a fixed seat of 24 inches for use in a residential kitchen. After a few years the consumer might remodel the kitchen and desire a bar stool with a seat height of 32 inches. Rather than buy a new bar stool, the consumer may attach leg extenders to the old 24 inch bar stool to raise the seat height to the desired level. By simply attaching an 8 inch leg extender to each leg of the 24 inch bar stool, the consumer may avoid the expense of having to buy an entirely new bar stool and still end up with a bar stool of the desired 32 inch height.

Likewise, a supplier may adapt a bar stool for a plurality of seat heights demanded by consumers. Rather than stock at least one bar stool of every height demanded by consumers in order to have a particular bar stool height on hand when a consumer orders, a supplier may reduce inventory by stocking only bar stools of a few predetermined seat heights and adapting the bar stools with leg extenders to meet consumer demand for bar stools of a seat height not maintained in inventory. To further reduce inventory, a supplier may stock a base unit bar stool of only a single seat height and add leg extenders of a plurality of lengths to produce bar stools with a plurality of seat heights.

For example, a first supplier that stocks a range of non-adjustable fixed height bar stools may have to stock at least one bar stool of a 24 inch seat height, at least one bar stool of a 30 inch seat height, and at least one bar stool of a 36 inch seat height in order to have at least one bar stool of each height on hand when a consumer places an order.

A second supplier that stocks adjustable height bar stools may only have to stock a base unit bar stool of a 24 inch seat height and leg extenders with a length of 6 inches and 12 inches. To meet consumer demand for a bar stool of a 30 inch seat height and a 36 inch seat height, the second supplier only has to attach the 6 inch and 12 inch leg extenders, respectively, to the base unit bar stool with a 24 inch seat height. Because the leg extenders take up less space than an entire bar stool, use of leg extenders helps to conserve storage space. Consequently, the second supplier may reduce inventory and storage space requirements by stocking a base unit bar stool and adapting the base unit bar stool to a plurality of heights by attaching leg extenders.

Figure 7:
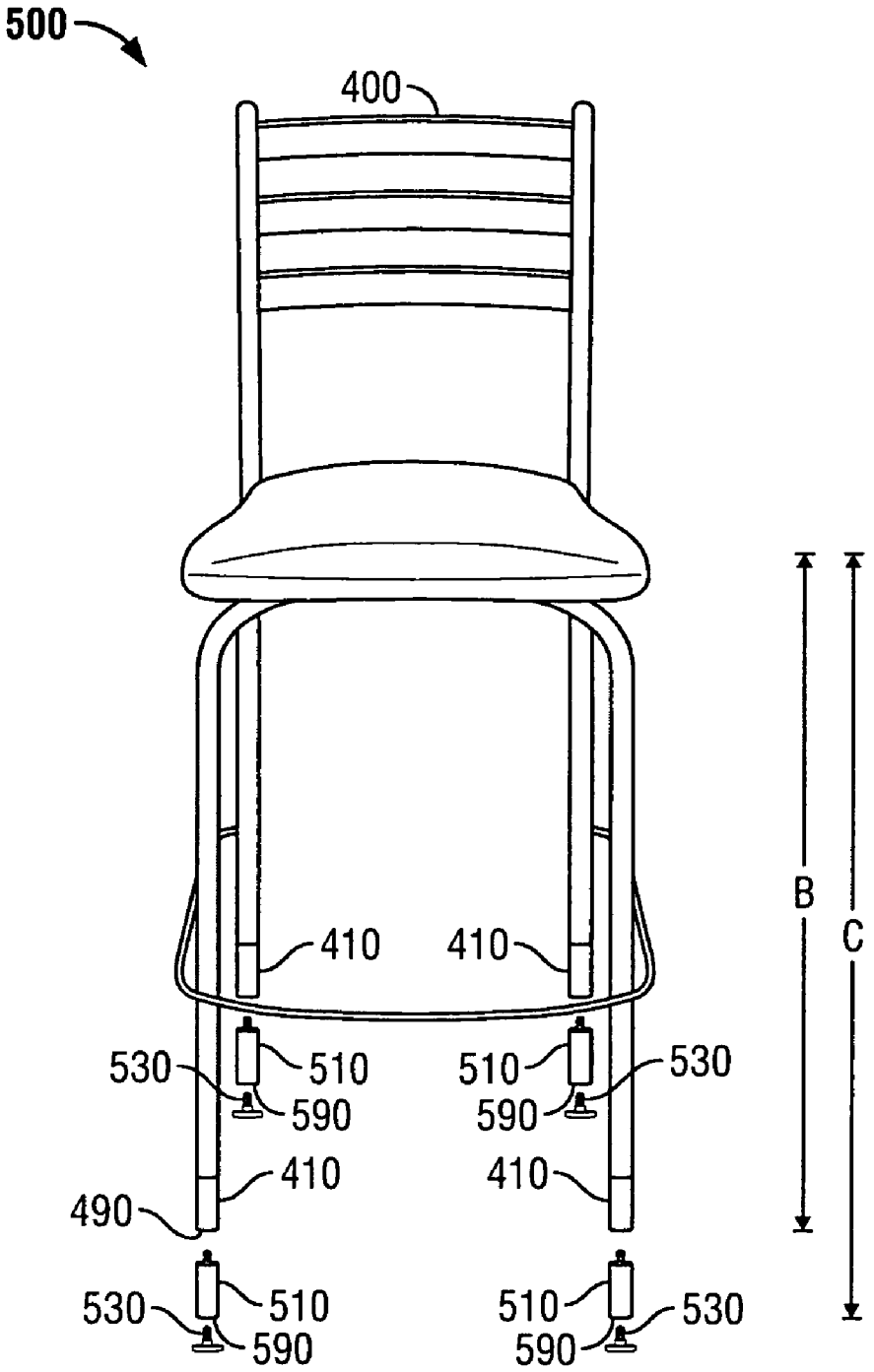
FIG. 7 illustrates a bar stool configured to an adjusted seat height with leg extenders in accordance with an embodiment of the present invention.

FIG. 7 illustrates the reconfigured bar stool 400 of FIG. 6 with a set of additional leg extenders 510 attached to produce a second reconfigured bar stool 500 in accordance with an embodiment of the invention. The additional leg extenders 510 may be similar to the leg extenders 410 shown in FIG. 8.

The additional leg extenders 510 engage the bottom surfaces 490 of the leg extenders 410. End caps 530 engage the bottom surfaces 590 of the additional leg extenders 510 with screw threaded connections. For example, to attach an additional leg extender 510 to the leg extender 410 of FIG. 8, the end cap 430 may be removed from the leg extender 410 and the additional leg extender 510 may engage the bottom surface 490 of the leg extender 410.

In operation, the reconfigured bar stool 400 of seat height B is provided. A second reconfigured seat height C of the reconfigured bar stool 400 is determined. One additional leg extender 510 for each leg of the reconfigured bar stool 400 is selected from a set of additional leg extenders 510 of a length that will adjust the reconfigured bar stool 400 from a reconfigured seat height B to a second reconfigured seat height of C.

After the additional leg extenders 510 have been selected, a male threaded connector on one end of each additional leg extender 510 is aligned with a respective female threaded connector located on the bottom surface of each of the leg extenders 410. Each additional leg extender 510 is threaded into the respective female threaded connector and rotated until a fixed stopping point is reached. The fixed stopping point is provided by a top surface of each additional leg extender 510 where the male threaded connector is attached to the additional leg extender 510. Consequently, the seat height of the reconfigured bar stool 400 is increased from a reconfigured seat height of B to a second reconfigured seat height of C with the additional leg extenders 510.

Because bottom surfaces 590 of the additional leg extenders 510 will be in contact with a floor surface when attached to the leg extenders 410, it may be desirable to provide a finished surface to the bottom surfaces 590 of the additional leg extenders 510. To provide a finished surface to the bottom surfaces 590 of the additional leg extenders 510, end caps 530 may be engaged with threaded connections to the bottom surfaces 590 of the additional leg extenders 510. A male threaded connector on the top of each end cap 530 is aligned with a respective female threaded connector located on the bottom surface 590 of each additional leg extender 510. Each end cap 530 is threaded into the respective female threaded connector and rotated until the top surface of each end cap 530 is reached.

To produce a desired level of friction between the second reconfigured bar stool 500 and a floor surface, the surface of the end caps 530 may be varied between a low friction surface and a high friction surface. For example, the surface of the end caps 530 may be smooth to provide a low friction surface and rubber coated or roughened to provide a higher friction surface.

In the alternative, the additional leg extenders 510 may engage the bottom surfaces 490 of the leg extenders 410 with wood pegs, dowels, glue, or other suitable means of engagement. Furthermore, the additional leg extenders 510 may include finished bottom surfaces 590 with a surface that does not require the attachment of end caps 530.

In an alternative embodiment, additional sets of leg extenders 510 may be continually engaged to previously added sets of leg extenders 410, 510 until a desired bar stool seat height has been obtained.

By attaching an additional set of leg extenders to already installed leg extenders, consumer costs may be reduced. By adding leg extenders to already installed leg extenders, a shorter leg extender may be used than if the already installed leg extender is entirely replaced with a new longer leg extender. A shorter leg extender may include less material, utilize less natural resources, and be less labor intensive to make than a longer extender. Resulting cost savings associated with shorter length leg extenders may then be passed on to consumers.

Furthermore, producing leg extenders that may be attached to other leg extenders allows for leg extenders to be manufactured and supplied in a modular format. Rather than produce leg extenders of a countless number of lengths to meet consumer demand for a countless number of desirable seat heights, a modular set of leg extenders of a few predetermined lengths may be produced. The modular set of leg extenders may then be combined in a plurality of combinations to extend the legs of a bar stool and raise the seat height of a bar stool to a plurality of desired seat heights.

For example, leg extenders in 1 inch, 3 inch, 6 inch and 12 inch lengths may be produced and included in a modular set of leg extenders. The modular set of leg extenders may then be used to increase the seat height of a bar stool from 24 inches to 27 inches by adding 3 inch leg extenders to each leg of the bar stool. The same modular set of leg extenders may also be used to raise the seat height of the 24 inch bar stool by 4 inches even though a 4 inch leg extender is not included in the modular set. The seat height of the 24 inch bar stool may be increased by four inches by adding both a 3 inch leg extender and a 1 inch leg extender to each of the bar stool legs to raise the bar stool seat height to 28 inches.

Also, suppliers may be able to reduce inventory by using leg extenders that may be attached to other leg extenders. Rather than stock bar stools of a countless number of heights, a supplier may stock a base unit bar stool of a single height. Along with the base unit bar stool, a supplier may stock leg extenders of a few predetermined lengths. Leg extenders may then be added to the base unit bar stool in a plurality of combinations to produce a bar stool with a desired seat height.

For example, a first supplier that stocks a range of non-adjustable fixed height bar stools may have to stock at least one bar stool of a 24 inch seat height, at least one bar stool of a 30 inch seat height, and at least one bar stool of a 36 inch seat height in order to have at least one bar stool of each height on hand when a consumer places an order.

A second supplier that stocks adjustable seat height bar stools may only have to stock a base unit bar stool of a 24 inch seat height and leg extenders with a length of 6 inches and 12 inches. To meet consumer demand for a bar stool of a 30 inch seat height and a 36 inch seat height, the second supplier only has to attach the 6 inch and 12 inch leg extenders, respectively, to the base unit bar stool of a 24 inch seat height.

To further reduce inventory, the second supplier may forego stocking the 12 inch leg extenders and only stock the 6 inch leg extenders. As before, to meet consumer demand for a bar stool of a 30 inch seat height, the second supplier would add a 6 inch leg extender to each leg of the 24 inch bar stool. However, to meet consumer demand for a bar stool with a 36 inch seat height, the second supplier would add two 6 inch leg extenders to each leg of the 24 inch bar stool rather than a 12 inch leg extender. Consequently, the second supplier may further reduce inventory and storage space requirements by stocking a base unit bar stool and a modular set of leg extenders that may be combined to produce bar stools of various heights.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A securely stacking bar stool including:

a seat with a forward motion restraining system wherein said forward motion restraining system includes a plurality of cut-out portions of said seat, wherein said plurality of cut-out portions are formed as indentations along the sides of the seat that extend to the rear of the seat, wherein said plurality of cut-out portions are adapted to receive the rear legs of a second bar stool when said second bar stool is stacked on said securely stacking bar stool;

a plurality of rear legs mechanically coupled to said seat;

a plurality of front legs mechanically coupled to said seat a footrest extending between one of said rear legs and one of said front legs, wherein said footrest includes a bend that is adapted to receive one of said rear legs of said second bar stool when said second bar stool is stacked on said securely stacking bar stool; and a backstop restraining system wherein said backstop restraining system includes at least one of a backrest or a rear leg, wherein said backrest and rear leg are coupled to said seat and positioned relative to said cut-out portion of said seat to engage said rear legs of said second bar stool when said second bar stool is stacked on said securely stacking bar stool, wherein said forward motion restraining system and said backstop restraining system operate to engage said rear legs of said second bar stool to restrain said second bar stool from sliding off the top of said securely stacking bar stool when said second bar stool is stacked on top of said securely stacking bar stool.

2. The securely stacking bar stool of claim 1 wherein said bend partially encompasses the leg of said second bar stool to restrain motion of said second bar stool when the second stool is stacked on said securely stackable stool.

3. A method of securely stacking bar stools comprising:

providing a securely stacking bar stool having:

a seat, wherein said seat includes a plurality of cut-out portions formed as indentations along the sides of said seat that extend to the rear of said seat, wherein said plurality of cut-out portions are adapted to receive the rear legs of a second bar stool when said second bar stool is stacked on said securely stacking bar stool;

a plurality of rear legs mechanically coupled to said seat;

a plurality of front legs mechanically coupled to said seat; and a footrest extending between one of said rear legs and one of said front legs, wherein said footrest includes a bend that is adapted to receive one of said rear legs of said second bar stool when said second bar stool is stacked on said securely stacking bar stool;

and stacking said second bar stool on top of said securely stacking bar stool, wherein stacking said second bar stool includes:

introducing the rear legs of said second bar stool into said cut-out portions of said securely stacking bar stool; and engaging one of the rear legs of said second bar stool with said bend in said footrest.

* * * * *